United States Patent [19]

Wyche

[11] 4,143,502

[45] Mar. 13, 1979

[54] METHOD OF ERECTING A STRUCTURAL ARCH SUPPORT

[76] Inventor: Cyril T. Wyche, 1140 Parkins Mill Rd., Greenville, S.C. 29607

[21] Appl. No.: 914,203

[22] Filed: Jun. 12, 1978

Related U.S. Application Data

[63] Continuation of Ser. No. 595,843, Jul. 14, 1975, abandoned.

[51] Int. Cl.[2] ..... E04B 1/00; E04G 21/00; E04G 23/00; E04B 1/32

[52] U.S. Cl. ..... 52/745; 52/80; 52/86; 52/88; 52/222; 52/223 R

[58] Field of Search ..... 52/80, 92, 81, 87, 86, 52/88, 93, 745, 747, 222, 223 R; 135/1 R, 3 R

[56] References Cited

U.S. PATENT DOCUMENTS

| | | | |
|---|---|---|---|
| 2,415,240 | 2/1947 | Fouhy | 52/745 |
| 2,752,868 | 7/1956 | Blumfield | 52/86 |
| 3,057,119 | 10/1962 | Kessler | 52/222 X |
| 3,226,892 | 1/1966 | Rose et al. | 52/80 |
| 3,475,768 | 11/1969 | Burton | 52/80 X |
| 3,480,023 | 11/1969 | McConnell et al. | 135/3 R |
| 3,676,964 | 7/1972 | Anglade, Jr. | 52/86 |
| 3,749,107 | 7/1973 | Laberge | 135/1 R |
| 3,889,433 | 6/1975 | Eubank, Jr. | 52/86 |
| 3,897,622 | 8/1975 | Utahara | 52/223 X |
| 3,909,993 | 10/1975 | Huddle | 52/86 X |

FOREIGN PATENT DOCUMENTS

| | | | |
|---|---|---|---|
| 165050 | 2/1953 | Australia | 52/80 |
| 1140687 | 8/1957 | France | 52/80 |
| 631553 | 5/1936 | Fed. Rep. of Germany | 52/80 |

*Primary Examiner*—Leslie Braun

*Attorney, Agent, or Firm*—Bailey, Dority & Flint

[57] ABSTRACT

A free span arch structure is illustrated including transversely spaced elongated flexible structural sections flexed from a substantially straight configuration when unflexed into a substantially parabolic configuration without exceeding the yield point of the structural sections so as to impart a permanent set thereto. Means are provided for supporting and for restraining the structural section adjacent the ends thereof against outward and downward movement retaining the sections flexed in the parabolic configuration. The method contemplates lifting structural sections, which are illustrated in the form of aluminum pipes, by exerting a lifting force as by a crane intermediate the ends thereof in a medial portion, and then raising an intermediate portion of the pipe by the application of the lifting force while supporting the opposed ends of the pipe as on the ground or otherwise as in the case of a roof, on the walls. When the pipe is lifted, the ends restrained and the lifting force removed with the pipe in a natural state of repose after the application of the load imposed by its own weight, the flexed pipe will assume a substantially parabolic configuration.

6 Claims, 7 Drawing Figures

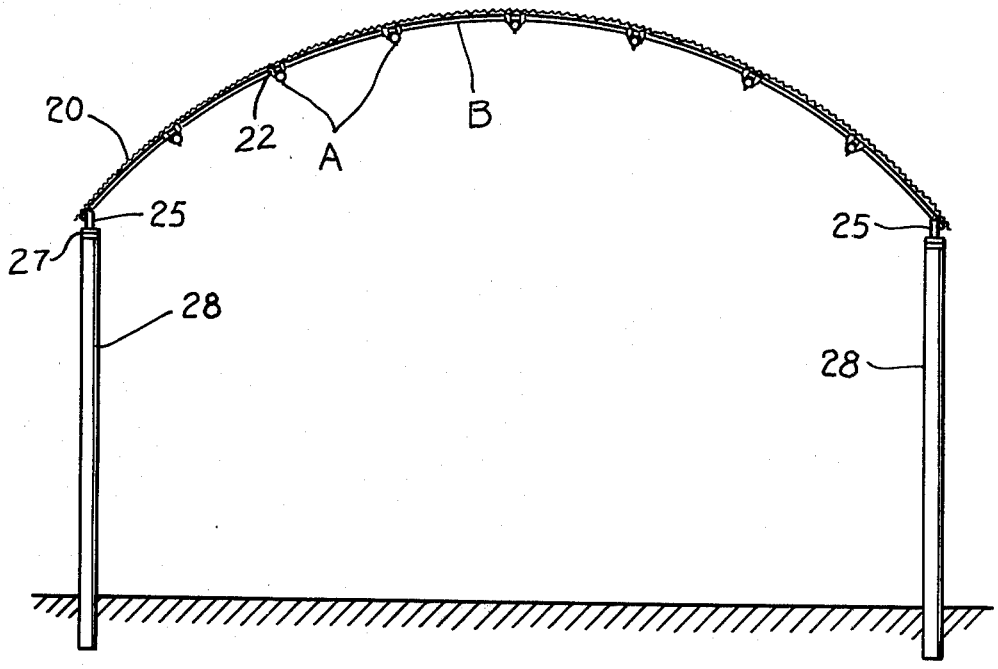
Fig. 5.
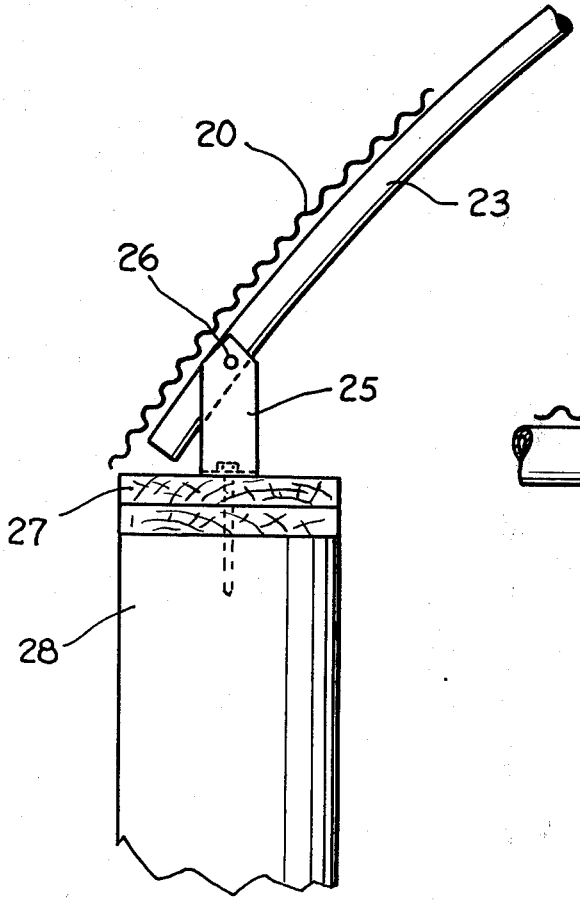
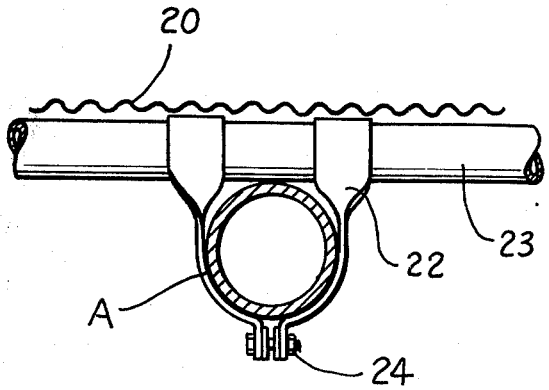
Fig. 6.
Fig. 7.

METHOD OF ERECTING A STRUCTURAL ARCH SUPPORT

This is a continuation of application Ser. No. 595,843, filed July 14, 1975, now abandoned.

BACKGROUND OF THE INVENTION

In tall structures, such as buildings with high ceilings, the cost of the substantial structural members necessitated by the usual rigid structural designs is excessive. Shell roof constructions have been provided in an effort to reduce costs, but such structures have been rigid as, for example, that shown in U.S. Pat. No. 3,226,892.

Similarly, in structures spanning spaces such as bridges, a rigid structural design is employed (except in design of suspension bridges).

Rigid structures are designed according to classical structural analysis which assumes linear, elastic, small displacement behavior in formulating mathematical equations to determine stresses and displacements. Such structures are often prefabricated or at least partially so for erection at the job site. The prior art structures depend upon such relative rigidity retaining a static condition while resisting loads imposed thereon. Since the prior art systems resist force in bending, they must be designed of substantial members capable of resisting relatively large bending moments.

SUMMARY OF THE INVENTION

The invention contemplates a structure characterized by large deflection wherein loads are distributed throughout the system in tension and compression as opposed to bending. The arch members are constructed by exerting a lifting force in the middle portion of an elongated flexible member while supporting the ends as upon the ground or walls during lifting. The flexibility of the structural member is such that if the application of the lifting force in the medial portion thereof were continued without supporting the ends, the structural member would simply bend double or become otherwise permanently deformed due to its own weight. After raising the flexible members with the ends supported, the ends are restrained and suitable lateral bracing is applied.

Accordingly, it is an important object of this invention to provide a novel arch structure which is easy to erect and which will rely upon flexibility for distributing loads in order to resist loads substantially in tension and compression making possible a simple, inexpensive structure which may be easily erected on the job site.

Another important object of the invention is to provide an erection technique or method which eliminates the use of falsework, shorings and the like, the structure being temporarily supported and fabricated in the ultimate shape from straight sections. Preferably, the structural sections may be standard pipe or tube sections, arcuate, square or rectangular in cross-section. It is also preferred that the sections be closed form and symmetrical so as to be tortionally stable against buckling.

A preferred embodiment of the invention will be described in the context of a structure suitable for use as a tennis court enclosure utilizing circular hollow aluminum pipes as the primary arch system, but it is to be understood that other suitable materials may be used and the structure itself may assume a variety of configurations suitable for a wide variety of structures and uses, including a bridge structure.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 5 is a transverse sectional elevation taken on the line 5—5 in FIG. 2, with parts omitted for clarity.

FIG. 6 is an enlarged transverse sectional elevation illustrating a means for joining a primary and secondary system of the building enclosure, and FIG. 7 is an enlarged sectional elevation illustrating the construction of the enclosure together with support for the transverse braces of the structure according to the present invention.

DESCRIPTION OF A PREFERRED EMBODIMENT

The drawings illustrate a free span arch roof structure for a building enclosure including a plurality of transversely spaced elongated flexible structural sections A. Each of the flexible structural sections are illustrated as pipe sections flexed from a substantially straight configuration when unflexed into a substantially parabolic configuration. Means B are provided for restraining each of the structural sections adjacent its ends against outward and downward movement retaining the structural sections flexed in the parabolic configuration against returning to the unflexed configuration. Means C illustrated in the form of a plurality of longitudinally spaced transverse arch supports bracing the structural sections laterally are maintaining the structural sections in a convex elevated position in a substantially vertical plane acting as arch supports for carrying uniform loads in direct compression.

Figure 2:
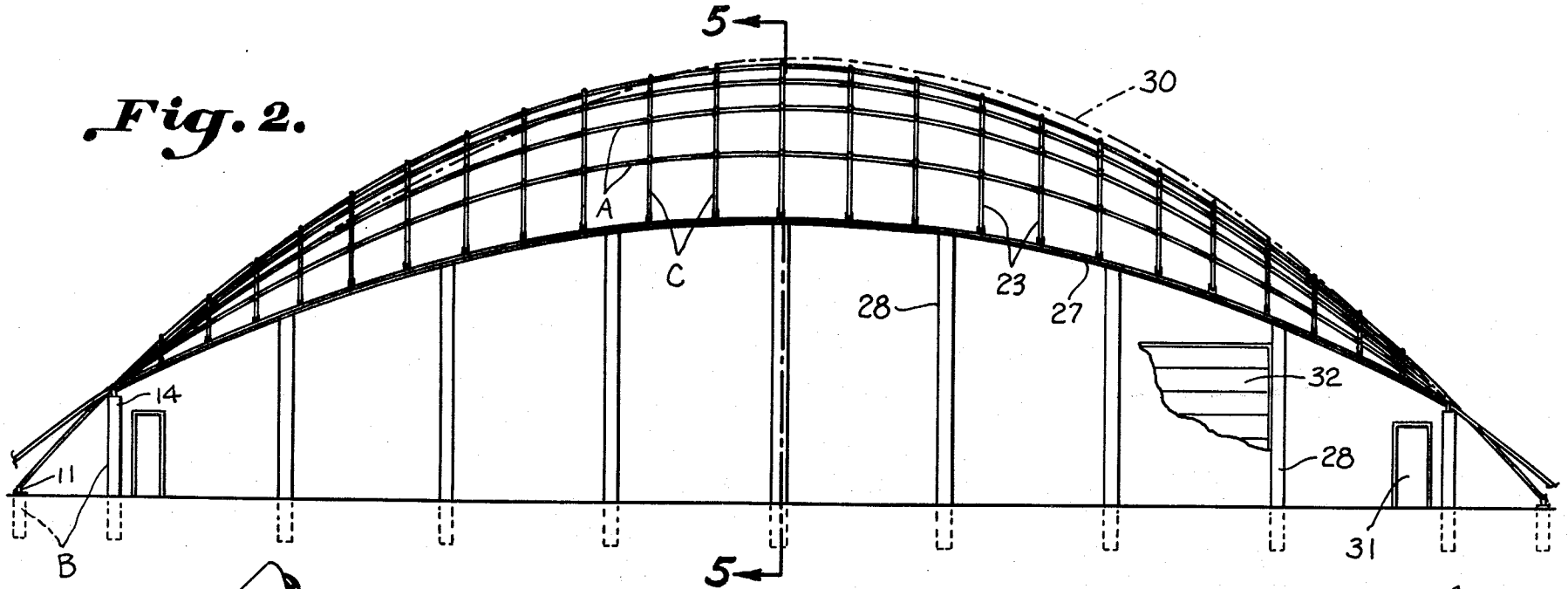
FIG. 2 is a schematic side elevation of an enclosure constructed in accordance with the present invention.
Figure 4:
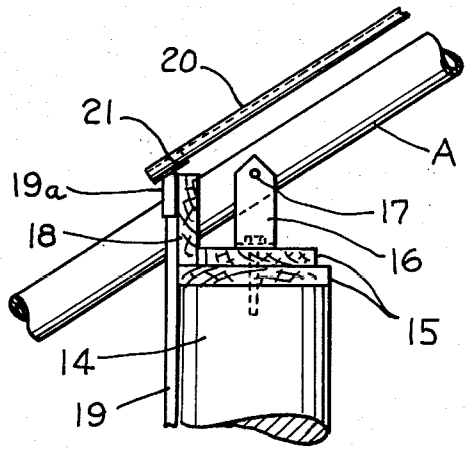
FIG. 4 is an enlarged side elevation further illustrating the end support means for the arch structures, with parts omitted.
Figure 1:
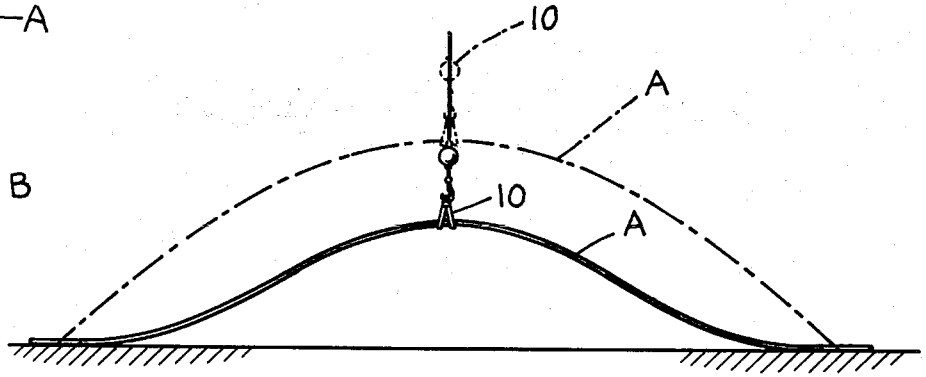
FIG. 1 is a schematic side elevation illustrating a pipe section being raised as by a crane in accordance with the method of the invention.

The pipe A is illustrated in FIG. 1 as being lifted in the medial portion thereof as by a crane hook from solid to broken line position. In FIG. 2, a plurality of transversely spaced pipes A, positioned in parallel vertical planes, are illustrated in a flexed position, secured at their ends to concrete abutments which are included in the means B for restraining each of the pipes adjacent the ends. By reference to FIG. 3, it will be noted that an abutment is illustrated as a reinforced concrete footing to which a clip angle 11 is secured as by the bolt 12. The structural member A is secured to the clip angle by means of a pivot pin 13. An additional abutment is illustrated in FIG. 4 as including a post 14 having runners 15 on the top thereof for mounting a clip angle 16 which is suitably attached to the runners. The structural member A is secured to the clip angle as by a pivot pin 17. A marginal runner 18 is employed to which suitable corrogated siding 19 is attached by a siding closure **19*a***. By reference to FIGS. 4 and 6, it will be noted that suitable corrogated panels 20 are secured by siding closure 21 and are supported by straps 22 which connect transverse circular arches illustrated in the form of pipes 23. The brackets are secured to the primary arch system member in the form of pipe A as by bolts 24. The roofing panels 20 may be in form of translucent plastic panels which are secured to the transverse circular arches of the secondary support system as illustrated in FIG. 6.

Figure 3:
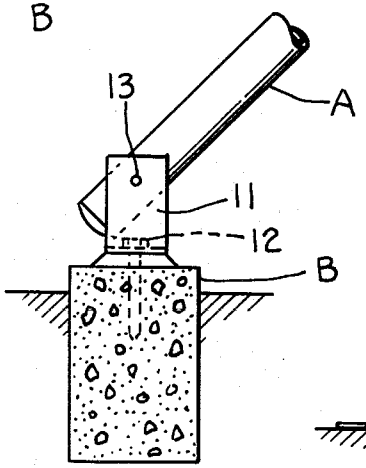
FIG. 3 is an enlarged side elevation illustrating a lower support for an arch structure constructed in accordance with the present invention.

FIG. 7 illustrates the means for attaching the circular arches 23 of the secondary system through clip angles 25 as by pivot pins 26. The clip angles 25 are suitably secured to runners 27 which are carried across the spaced vertical posts 28. The posts 28 are illustrated in FIGS. 2 and 3 as being imbedded in the earth so as to support the weight imposed upon them.

FIG. 2 illustrates, by the broken line designated at 30, a deflection curve showing the position a structural member A would assume under a wind load of 110 m.p.h. blowing from left to right in FIG. 1 with the left-hand portion of the structural member A acting substantially in compression with the right-hand portion substantially in tension. The load would be distributed to the primary and secondary members of the system through such deflection. In contrast, a rigid arch, since it cannot substantially deform, must carry an unbalanced load in bending stress. The circular transverse arches C form the bracing or secondary structure system and help distribute the load. It will be noted that doors 31 may be provided at any desired location and that louvers 32 may be utilized for ventilization.

It is important to note that were a steel pipe utilized as a structural section A, it would probably not work because such a pipe, if it were to assume a parabolic configuration as set forth herein, would necessarily be subjected to excessive stresses which would result in permanent deformation. It is essential that the stresses to which the structural member is subjected, on being raised as set forth herein, not exceed the allowable stresses. In other words, the yield point must not be exceeded to such an extent as to put a substantial set or permanent deformation in the structural member. The pipe illustrated in the drawings is continuous and of uniform cross section, however, sleeve couplings may be used at reasonable intervals.

It is also important that the structural member be lifted without the ends coming off the ground or other suitable support medium as illustrated in FIG. 1. When the force is applied to lift the pipe or structural member, it assumes a generally parabolic configuration, as illustrated in broken line position in FIG. 1, but not the exact shape assumed when the structural member is in final position, the lifting force removed, and the structure is at rest and subjected to the force of its own weight as illustrated in FIG. 2. It will be noted that there is no horizontal thrust at the ends of the pipe until the lifting force is removed and the parabolic arch configuration described herein is achieved. The inherent resiliency of the flexed structural members as described herein, upon removal of the lifting force, will exert an outward and downward force because the flexed member will tend to return to unflexed position because no permanent deformation or set has been placed therein.

The design of a structure in accordance with the present invention will now be considered.

Large Deflection Analysis of Aluminum Pipe

The problem and its solution may, for example, involve the following considerations. A long, slender pipe, initially resting on the ground, is lifted at its center point to a pre-selected height. Tests have verified that, for the mid-point heights of interest, the ends of the pipe remain in contact with the ground. When the ends of the pipe are a pre-selected distance apart, the ends of the pipe are affixed to hinges and the lifting load is relaxed. The pipe then assumes a curved form approximately that of a parabola.

The design information supplied consists of the final distance between the end of the pipe and the final vertical height to the center of the pipe. The objective of the analysis is to:

(a) determine the necessary length of pipe to meet the above design objectives;
(b) determine the height to which the mid-point of the pipe must be lifted in order that the ends of the pipe reach the pre-selected separation distance.

The analysis is divided into two separate stages. Given the final mid-point height of the pipe ($\bar{y}$) and the final separation distance between end points of the pipe ($2\bar{x}$), determine the necessary length of pipe to meet these objectives. The final deflected shape of the pipe, bending moments, stresses and reactions will be known when the length of pipe has been determined.

Assumptions:

(a) Plane sections remain plane;
(b) Axial deformations negligible for this problem;
(c) Transverse deflections very large; small deflection theory inadequate.

Comments regarding Analysis:

(a) Due to symmetry, only half of structure need be analyzed;
(b) Origin of x-y rectangular coordinates chosen at mid-point of pipe;
(c) Coordinate s, distance measured along curved shape of pipe from origin, used as independent coordinate;

From assumption (a)

$$1/\rho = M/EI$$

where $\rho$ = radius of curvature
M = bending moment
EI = bending stiffness
In general, $$\frac{1}{\rho} = \frac{\frac{d^2y}{dx^2}}{\left[1 + \left(\frac{dy}{dx}\right)^2\right]^{3/2}}$$

The following equation has been derived for use in the analysis by transforming coordinates and applying standard equations of statics:

$$\frac{d^3y}{ds^3} + \frac{\frac{dy}{ds}\left(\frac{d^2y}{ds^2}\right)^2}{1-\left(\frac{dy}{ds}\right)^2} + \sqrt{1-\left(\frac{dy}{ds}\right)^2}$$

$$\left\{\frac{H}{EI}\ \frac{dy}{ds} + \frac{Ws}{EI}\sqrt{1-\left(\frac{dy}{ds}\right)^2}\right\} = 0$$

where s = a coordinate measured along the length of the pipe,

H = horizontal component of compression load

W = weight of pipe

This equation is the basic non-linear differential equation which relates the displacement y to the independent coordinate s. The equation may then be solved using standard numerical integration techniques.

In the tennis court enclosure illustrated, for example, the four posts on each side of center are equally spaced at 15 foot intervals and there is a 60 foot inside width. The height of the central arch A is 40 feet at the middle and the circular arch C has a radius of 40 feet at that point. The outside diameter of the aluminum pipes is 3½ inches, a weight of 3 15/100 pounds per foot and a cross-sectional area of 2 68/100 square inches. The arch B is of 1¼ inch diameter aluminum pipe.

It may be observed that by lifting a straight structural section from ground to a predetermined position with the ends supported, restraining the ends and releasing the lifting force, the section assumes a parabolic shape which is structurably a highly efficient geometric shape to carry loads. The arch is efficient because uniform loads are carried in direct compression. The parabola is a preferred arch configuration because such an arch will carry uniform loads in direct compression wherein a circle arch will not. An arch under load changes geometry under load and is not a rigid system. A rigid arch such as in a bridge does not change in shape. Some members of the structure illustrated, under certain conditions of load, actually are in tension and this is not true of a rigid arch.

Thus, the arch structure approaches "membrane" behavior in that excess bending or compression, as would buckle the arch, is prevented by the arch changing shape.

While a preferred embodiment of the invention has been described using specific terms, such description is for illustrative purposes only, and it is to be understood that changes and variations may be made without departing from the spirit or scope of the following claims.

What is claimed is:

1. The method of erecting a structural arch support comprising the steps of:

lifting an elongated flexible structural section by exerting a lifting force intermediate the ends of the structural section adjacent a medial portion thereof;

raising an intermediate portion of said structural section by further application of said lifting force to a predetermined elevation while continually supporting said structural section adjacent its ends during said raising so that said structural section assumes a substantially parabolic configuration;

then restraining the structural section adjacent its ends against outward movement after application of said lifting force while continuing the application of such force intermediate the ends and adjacent the ends as necessary to support the section in such substantially parabolic configuration;

discontinuing the application of said force; and bracing said structural section laterally maintaining said structural section in elevated position acting as an arch support for carrying uniform loads in direct compression.

2. The method set forth in claim 1 including so erecting and bracing a plurality of such arch supports in transversely spaced algined relation to each other.

3. The method set forth in claim 1 wherein bracing said structural section laterally includes placing a substantially circular arch support transversely of said structural section intermediate the ends thereof in intersection relation thereto and fastening said structural section to said circular arch support adjacent an intersection thereof.

4. The method set forth in claim 2 wherein bracing said structural section laterally includes placing a plurality of substantially circular arch supports transversely of said structural section longitudinally spaced intermediate the ends thereof, and fastening said structural sections to said circular arch supports adjacent intersections thereof forming a structural system wherein loads are distributed between arch supports.

5. The method of erecting structural arch supports for a roof having a free span including:

applying a lifting member to an elongated flexible pipe section intermediate the ends of the pipe section;

applying a lifting force through said lifting member raising an intermediate portion of said pipe section to a predetermined elevation while continually supporting said pipe section adjacent its ends during said raising so that said pipe section assumes a substantially parabolic configuration;

restraining the pipe section adjacent its ends against outward and lateral movement;

successively so attaching, applying a lifting force and restraining a plurality of such pipe sections; and bracing said pipe sections laterally maintaining said pipe section in elevated position acting as an arch support for carrying uniform loads in direct compression.

6. The method set forth in claim 5 wherein bracing said pipe sections includes placing a plurality of substantially circular arch supports transversely of said pipe section longitudinally spaced intermediate the ends thereof, fastening said pipe sections to said circular arch supports adjacent intersections forming a structural system wherein loads are distributed between arch supports, and covering the structural system with roofing material.

* * * * *